US006234184B1

(12) United States Patent
Tuller et al.

(10) Patent No.: US 6,234,184 B1
(45) Date of Patent: May 22, 2001

(54) SECONDARY FILTER SYSTEM

(75) Inventors: Barry E. Tuller, Humboldt; Daniel Hruby, Jackson, both of TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/453,603

(22) Filed: Nov. 15, 1999

Related U.S. Application Data

(63) Continuation of application No. 09/018,031, filed on Feb. 3, 1998, now abandoned.

(51) Int. Cl.[7] ..... B08B 3/02

(52) U.S. Cl. ..... 134/104.1; 134/104.4; 134/111

(58) Field of Search ..... 134/10, 104.1, 134/104.4, 111; 210/412, 409

(56) References Cited

U.S. PATENT DOCUMENTS

| | | | | |
|---|---|---|---|---|
| 3,082,779 | | 3/1963 | Jacobs . | |
| 4,150,680 | | 4/1979 | Johnson et al. . | |
| 4,559,959 | | 12/1985 | Meyers . | |
| 4,612,947 | | 9/1986 | Duncan . | |
| 4,673,441 | | 6/1987 | Mayers . | |
| 4,832,575 | * | 5/1989 | Miller . | |
| 5,097,855 | | 3/1992 | Martinsson et al. . | |
| 5,165,435 | * | 11/1992 | Thies et al. . | |
| 5,601,660 | * | 2/1997 | Jeon et al. | 134/111 |
| 5,609,172 | * | 3/1997 | Chang et al. | 134/111 |
| 5,623,956 | | 4/1997 | Kirkland . | |
| 5,685,697 | * | 11/1997 | Buchanan, Jr. et al. . | |
| 5,711,325 | * | 1/1998 | Kloss et al. | 134/111 |
| 5,803,100 | | 9/1998 | Thies . | |

* cited by examiner

*Primary Examiner*—Frankie L. Stinson
(74) *Attorney, Agent, or Firm*—Zarley, McKee, Thomte, Voorhees & Sease

(57) ABSTRACT

A secondary filter of the present invention is adapted to provide for secondary filtering of wash water that has already been filtered by a primary filter to further remove very fine particles and therefore reduce the deposit of particles on the dishes being washed. The secondary filter is comprised of an annular chamber having an input port in communication with the pump and an output port in communication with the drain. The top of the annular chamber includes a plurality of openings covered by a fine mesh to allow wash water to pass but not fine particles. While the dishwasher is draining, any wash water and particles in the annular chamber will be flushed out through the output port.

7 Claims, 8 Drawing Sheets

SECONDARY FILTER SYSTEM

This application is a continuation of Ser. No. 09/018,031, filed Feb. 3, 1998, now abandoned.

BACKGROUND OF THE INVENTION

1. Field of the Invention

The present invention relates to dishwashers. More particularly, though not exclusively, the present invention relates to an apparatus and method for providing secondary filtering of wash water in a dishwasher.

2. Problems in the Art

Typical prior art dishwashers include a washing chamber having side walls, a top wall, a bottom wall, and a wash water circulation system mounted in the bottom wall of the washing chamber. The wash water circulation system pumps wash water upwardly through a lower rotating wash arm and downwardly through an upper rotating wash arm for spraying wash water onto the dishes and other articles to be cleaned within the washing chamber. The wash water sprayed from the wash arms typically collects in the bottom of the washing chamber and is strained to remove large food particles from the wash water. The strained wash water is then recirculated by the water circulation system for further spraying onto the dishes.

One problem with prior art wash water circulation systems in dishwashers is that small food particles may pass through the strainer and then through the wash water circulation system. The small food particles recirculate in the wash water circulation system and may become redeposited on the articles being washed.

FEATURES OF THE INVENTION

A general feature of the present invention is the provision of a method and apparatus for providing a secondary filter system for dishwashers which overcomes problems found in the art.

A further feature of the present invention is the provision of a method and apparatus for providing a secondary filter system for dishwashers which filters wash water that has already been filtered by a primary filter.

Further features, objects and advantages of the present invention include:

A method and apparatus for providing a secondary filter system for dishwashers which includes a hollow chamber having input and output ports and filtering elements.

A method and apparatus for providing a secondary filter system for dishwashers which has the ability to purge filtered particles from the secondary filter.

A method and apparatus for providing a secondary filter system for dishwashers which includes a hollow chamber having input and output ports and a check valve in communication with the output port.

A method and apparatus for providing a secondary filter system for dishwashers which includes a hollow chamber having input and output ports, a check valve in communication with the output port, and a sensor for sensing the position of the check valve.

A method and apparatus for providing a secondary filter system for dishwashers which is incorporated into the dishwasher pump module.

A method and apparatus for providing a secondary filter system for dishwashers which filters the wash water that has already been filtered to further remove small particles.

These as well as other features, objects and advantages of the present invention will become apparent from the following specification and claims.

SUMMARY OF THE INVENTION

A secondary filter system of the present invention is used in a dishwasher to filter debris from the wash water. The invention is comprised of a primary filter and a secondary filter. The secondary filter filters wash water that has already been filtered by the primary filter. A secondary filter of the present invention may optionally be comprised of a chamber having an input port in communication with the pump and an output port in communication with the drain. The chamber may include a plurality of openings with filter elements in communication with the openings for filtering water passing through the openings. The output port includes a check valve for preventing water from entering the chamber from the output port.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalencies which may be included within the spirit and scope of the invention.

Figure 1:
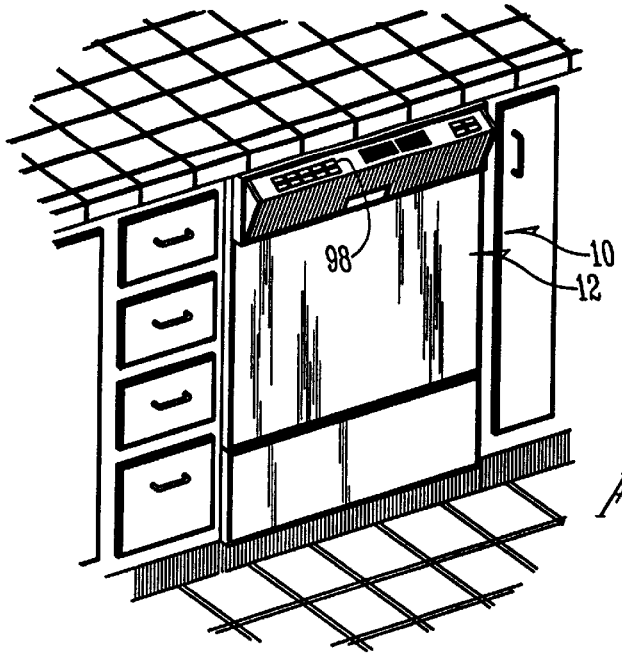
FIG. 1 is a perspective view showing a dishwasher of the present invention.

FIG. 1 shows a dishwasher 10 including an access door 12 pivotally movable between an open position and the closed position shown in FIG. 1. The dishwasher 10 includes side walls, a bottom wall, and a top wall, which together with the access door 12 define a washing chamber. The above described structure of the dishwasher 10 is conventional and does not form a part of the present invention. Disposed within the washing chamber is a pump assembly which is described in detail below.

Figure 2:
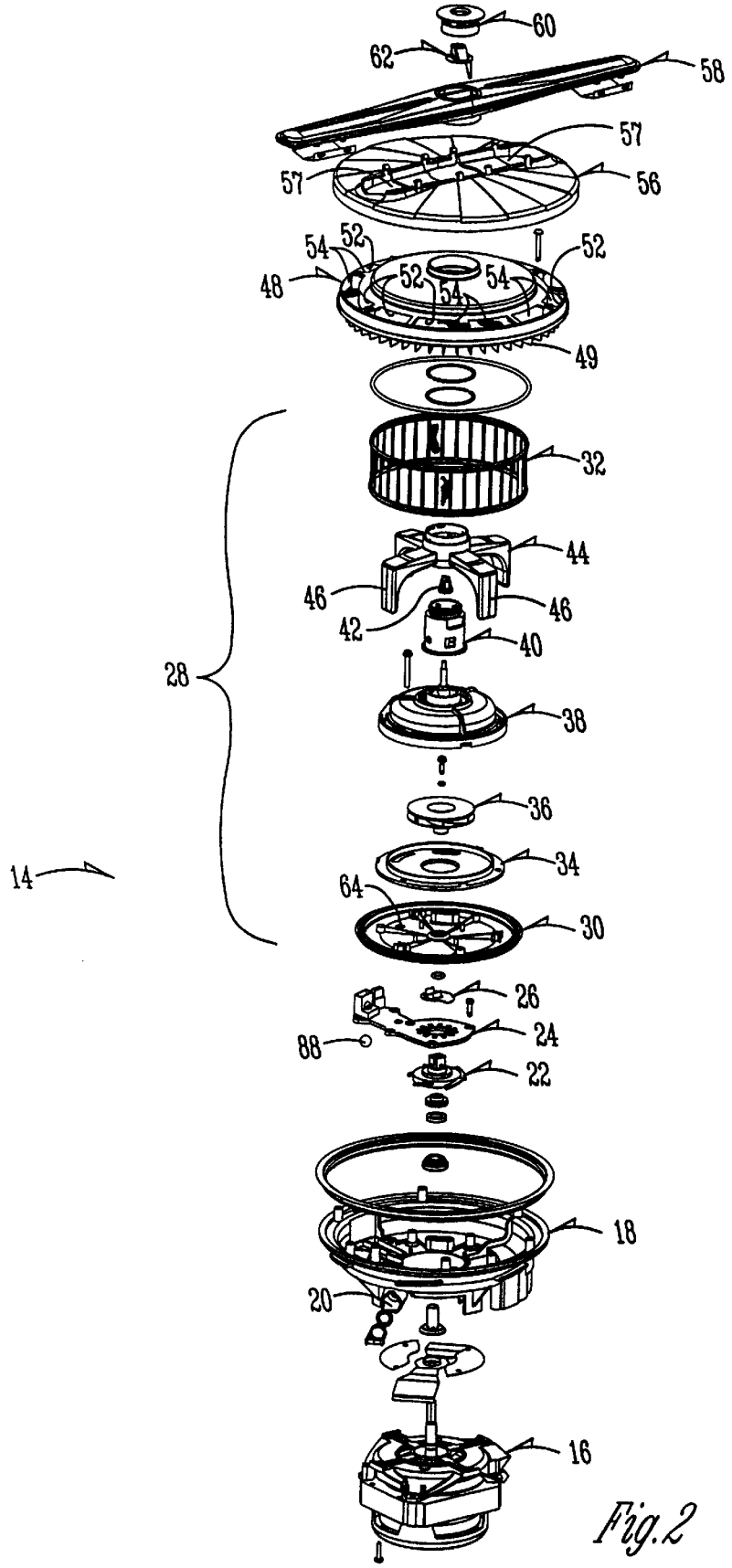
FIG. 2 is an exploded view of the dishwasher pump assembly of the present invention.

FIG. 2 is an exploded view of the dishwasher pump assembly 14 of the present invention. The pump assembly 14 includes a motor 16 which provides mechanical power to the pump assembly 14. The motor can be operated in two directions to either provide wash water to the dishwasher or to drain the dishwasher. Disposed above the motor 16 is a pump housing 18 which includes a drain outlet 20 for facilitating the removal of soil laden wash water from the dishwasher 10. Coupled to the shaft of the motor 16 is the drain impeller 22 which, when rotated in a first direction, pumps wash water out of the dishwasher 10 and through the drain outlet 20, and in a second direction, pumps wash water in an upward direction. Covering the drain impeller 22 and the opening to the drain outlet 20, is a drain cover 24 which is described in more detail below. Coupled to the drain impeller 22 and disposed above the drain cover 24 is a cutter disk 26 which rotates with the motor 16 and cuts large chunks of food that pass between strainer ribs 49 of the secondary filter assembly 48.

Disposed above the drain cover 24 is the primary filter assembly 28. The primary filter assembly 28 includes a filter support 30 which is coupled to a cylindrically shaped primary filter 32 which has perforated sides and acts as a strainer to strain large food particles from the wash water. Above the filter support 30 is a suction plate 34 and an impeller 36 which rotates with the shaft of the motor 16. An upper discharge housing 38 is disposed above the suction plate 34 and encloses the impeller 36. The upper discharge housing 38 is secured to the suction plate 34 by screws which extend through the suction plate 34 and into the pump housing 18. A wash arm support 40 is disposed above the upper discharge housing 38 and is secured in place by a nut 42. A rinse arm assembly 44 is adapted to fit around the wash arm support 40 and is rotatable with the wash arm support 40 relative to the primary filter 32. The rinse arm assembly 44 is generally hollow with slots 46 formed such that water spraying from the slots 46 will clean the primary filter 32 as the rinse arm assembly 44 rotates.

Disposed above the primary filter assembly 28 is the secondary filter assembly 48 of the present invention. The secondary filter assembly 48 includes an annular chamber 50 (shown and described in more detail below) extending around the periphery of the secondary filter assembly 48. The annular chamber 50 includes a plurality of openings 52 which are each covered by a fine mesh or screen 54 which allows the passage of wash water but not fine particles.

Above the secondary filter assembly 48 is a filter guard 56 which helps to protect the screen 54 of the secondary filter assembly 48 from damage that might be inflicted by falling silverware or other sharp items being washed. The filter guard 56 is attached to the underside of the lower wash arm 58 which is secured to the wash arm support 40 by the wash arm cap 60. The filter guard 56 has a pair of openings 57 which allow spray holes (not shown) in the bottom of the lower wash arm 58 to direct wash water downwardly onto the screen 54 in openings 52 for knocking particles from the inside of the screen 54 as the lower wash arm 58 rotates. Disposed below the wash arm cap 60 is the jump-up nozzle 62 which sprays wash water upward into the wash chamber.

Figure 3:
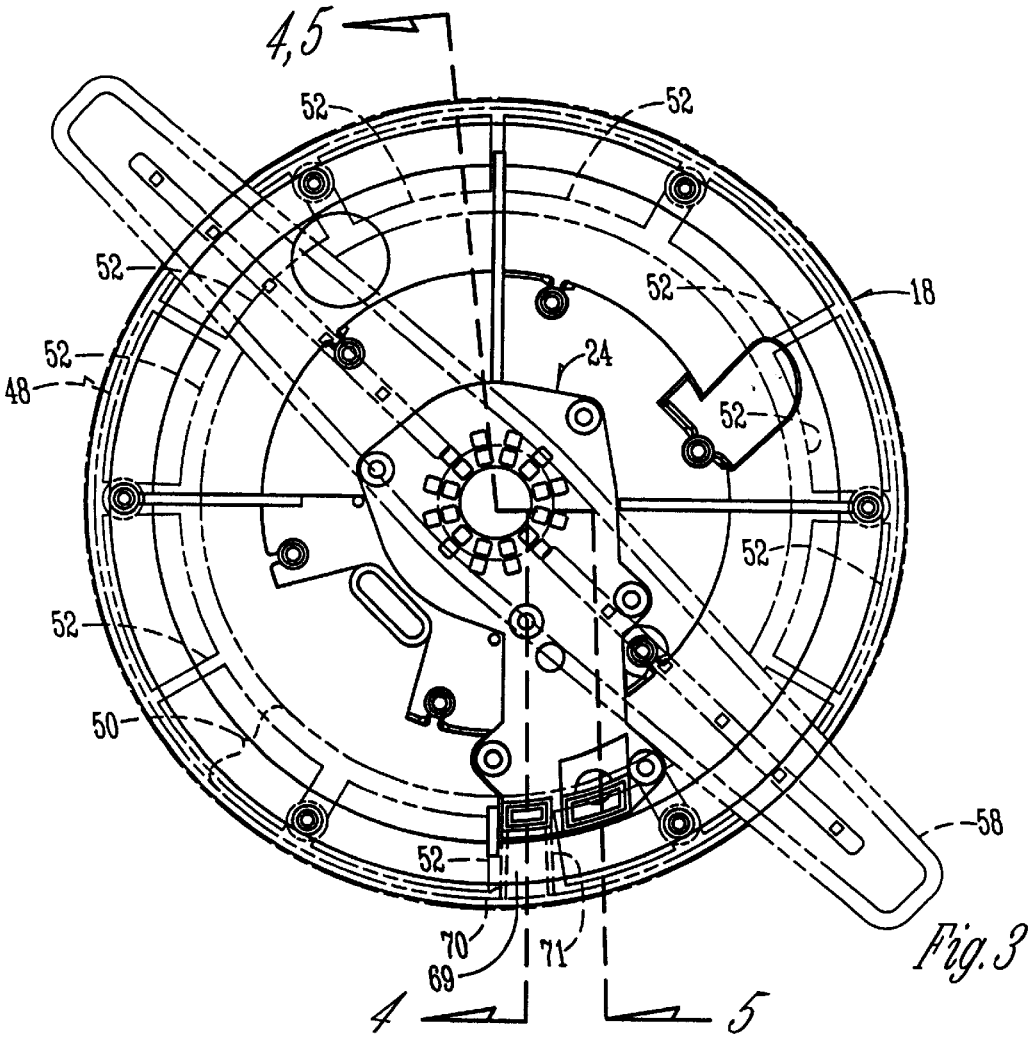
FIG. 3 is a top view of a portion of the pump assembly.

FIG. 3 is a top view of portions of the pump assembly 14 shown in FIG. 2. The pump housing 18 and drain cover 24 are shown in solid lines, while the secondary filter assembly 48 and lower wash arm 58 are shown in dashed lines.

Figure 4:
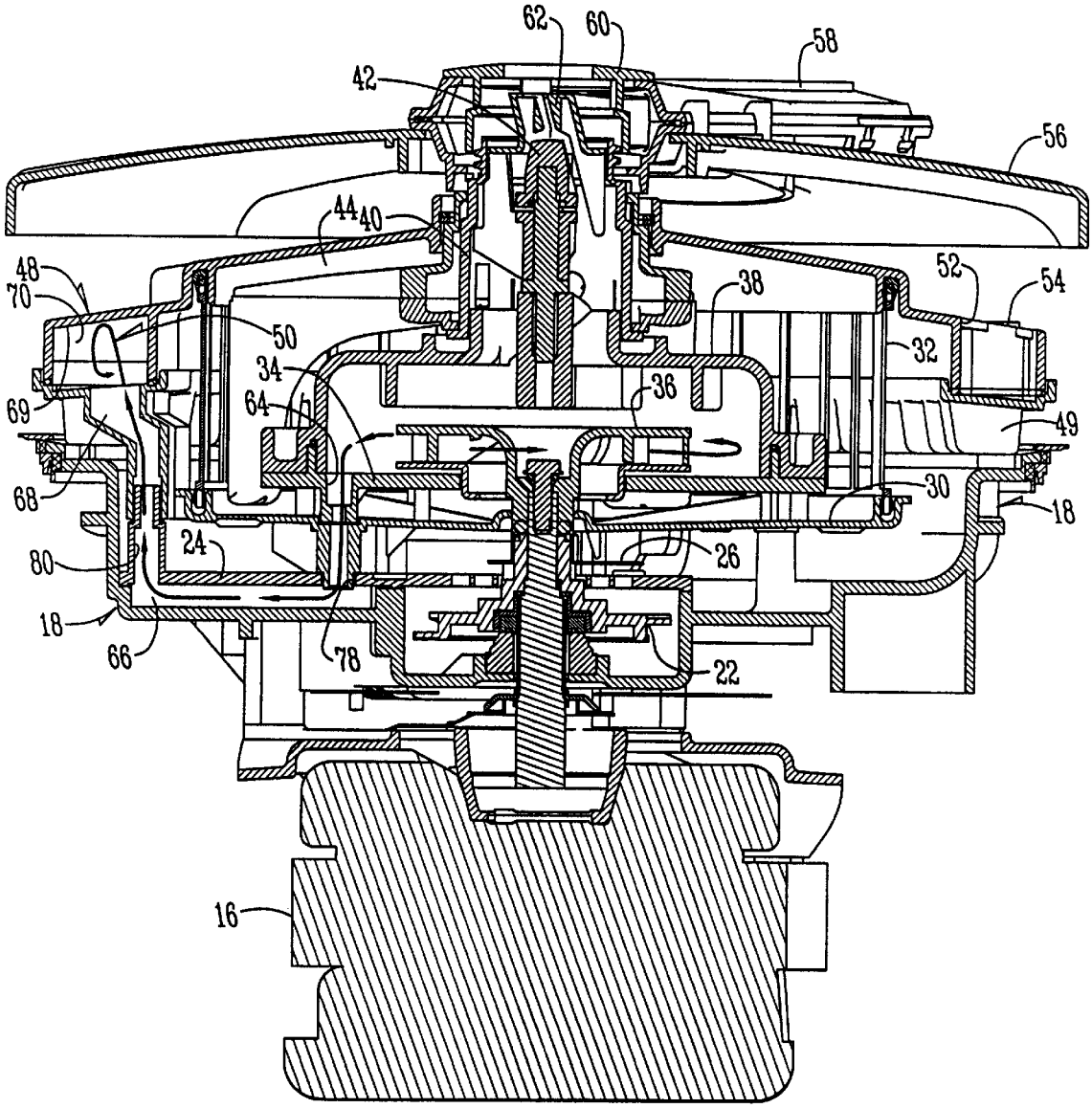
FIG. 4 is a sectional view of the pump assembly taken along lines 4—4 of FIG. 3.
Figure 5:
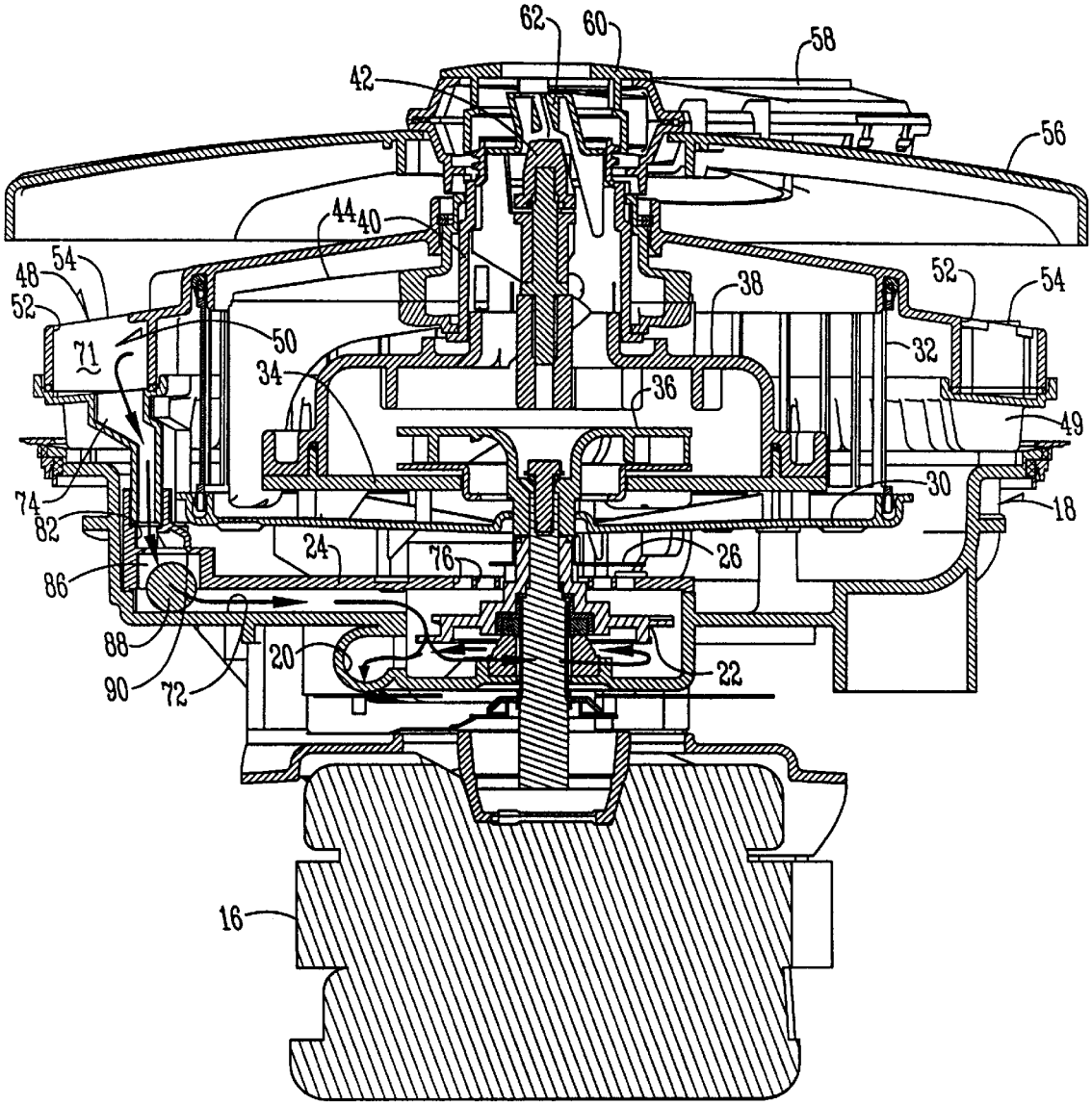
FIG. 5 is a sectional view of the pump assembly taken along lines 5—5 of FIG. 3.

As mentioned before, the pump assembly 14 operates primarily in two modes, washing and draining. When the motor 16 rotates in a first direction, the pump assembly 14 pumps wash water through the lower wash arm 58 and upper wash arm (not shown) to wash or rinse the articles in the dishwasher. When the motor 16 rotates in a second direction, the wash water collected at the bottom of the washing chamber is drained through the drain outlet 20. FIG. 4 is a sectional view illustrating the washing or rinsing mode. FIG. 5 is a sectional view illustrating the draining mode.

Again, FIG. 4 is a sectional view of the pump assembly 14. The arrows shown in FIG. 4 illustrate the path that wash water takes during the secondary filtration operation. Note that during the washing or rinsing cycle, wash water also flows through the primary filter 32 into the intake area of the impeller 36, to the lower wash arm 58, the upper wash arm, and the rinse arm assembly 44.

When the impeller 36 is rotated by the motor 16, it draws wash water through the primary filter 32 and then from below the suction plate 34 and into the housing formed by the upper discharge housing 38 and the suction plate 34. From there, a portion of the wash water flows through an opening 64 in the suction plate 34 and into a first channel 66 formed between the pump housing 18 and the drain cover 24 (described in detail below). The first channel 66 extends upward, as shown, where it is in communication with an input channel 68 of the secondary filter assembly 48. As wash water flows through the input channel 68 and into the annular chamber 50, it will first hit the upper wall 69 of the secondary filter assembly 48 so that the wash water is forced to travel under the side wall 70 and then around the annular chamber 50. The divider wall 71 (FIGS. 3 and 5) causes the water to flow around the annular chamber 50 in only one direction. As shown best in FIG. 3, the upper portion of the secondary filter assembly 48 is almost entirely comprised of the openings 52 and the mesh screen 54 except in the proximity of the input chamber 68 where the upper wall 69 is formed (FIG. 4). As water fills the annular chamber 50, the wash water will begin to flow out of the annular chamber 50 through the openings 52. In order to go through the openings 52, the wash water must pass through the screen or mesh 54. As a result, the fine food particles and dirt will become trapped on the screen 54 and will be knocked off by wash water directed downwardly through the previously mentioned spray holes in the lower wash arm 58. The fine food particles will be deposited within the annular chamber 50 while the secondarily filtered water is allowed to flow into the wash chamber.

The portion of the wash water that does not pass through the secondary filter assembly 48, as described above, will flow through the pump assembly 14 in a somewhat conventional fashion. A portion of the wash water will flow upward from the upper discharge housing 38 and eventually through the lower wash arm 58 where it sprays the dishes in the wash chamber. Wash water will also flow through the jump-up nozzle 62 into a spray tower (not shown) and onto the dishes. Some wash water also flows into the rinse arm assembly 44 and through the slots 46 in order to clean debris from the primary filter 32 as the rinse arm assembly 44 rotates. As the wash water collects at the bottom of the wash chamber, it will flow back into the pump assembly 14 through the space formed between the strainer ribs 49 of the secondary filter assembly 48 and the pump housing 18 as best shown in FIGS. 2–4.

As the impeller 36 draws wash water into the upper discharge housing 38, the wash water must pass through the primary filter 32. As a result, the wash water that flows through the secondary filter assembly 48 is wash water that has already been completely filtered by the primary filter 32. Although not shown in FIG. 4, the impeller 36 also pumps wash water to the upper wash arm to spray downward on the articles to be washed.

FIG. 5 is a sectional view illustrating the operation of the pump assembly 14 during the draining mode. In the draining mode, the shaft of motor 16 rotates in the opposite direction, which causes the drain impeller 22 to draw wash water downward into the drain outlet 20 where it is drained from the dishwasher 10. The arrows in FIG. 5 show the flow of wash water from the secondary filter assembly 48 to the outlet drain 20. For clarity, the arrows show only the flow of wash water from the secondary filter assembly 48. As shown, wash water is drawn by the impeller 22 from the second or drain channel 72 formed between the drain cover 24 and the pump housing 18 (described in detail below). Wash water is drawn into the second channel 72 from the output channel 74 of the secondary filter assembly 48. This draws wash water from within the annular chamber 50 to the drain, carrying with it the fine food and dirt particles filtered by the mesh screen 54. As a result, the filtered particles from the secondary filter assembly 48 are flushed out through the drain outlet 20. The wash impeller 36 also continues to pump while in reverse rotation so that wash water is forced through opening 64 and into the input channel 68. This action aids in flushing the collected small particles from the secondary filter assembly 48.

At the same time, the wash chamber of the dishwasher 10 is also drained in a conventional fashion. Wash water is drawn into the pump assembly 14 from the space formed between the strainer ribs 49 of the secondary filter assembly 48 and the pump housing 18 where it is drawn through the holes 76 formed in the drain cover 24. Large particles of food are chopped up as the wash water flows through the drain cover 24. The wash water then flows out the drain outlet 20.

Figure 6:
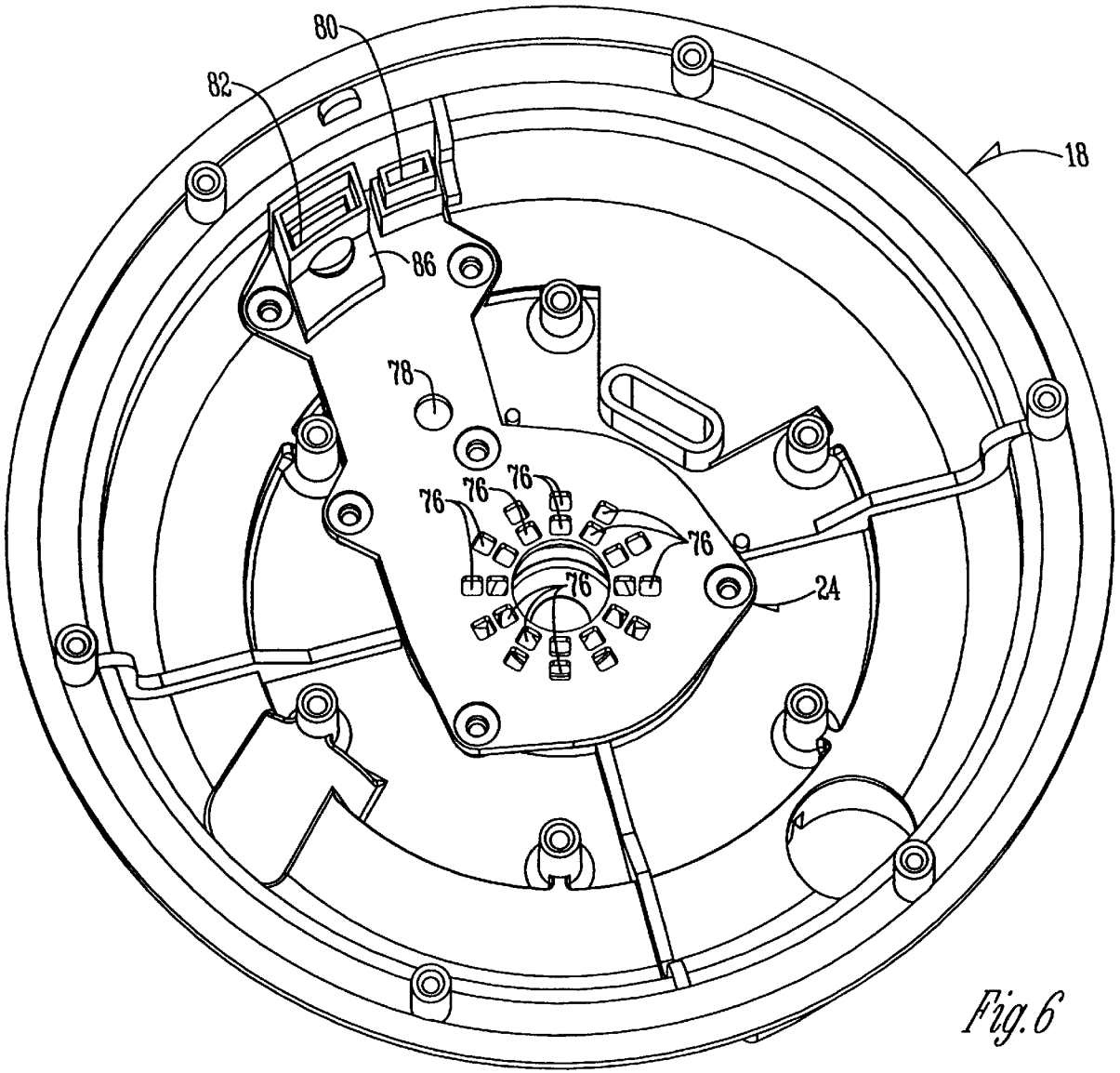
FIG. 6 is a perspective view of the pump housing and drain cover of the present invention.
Figure 7:
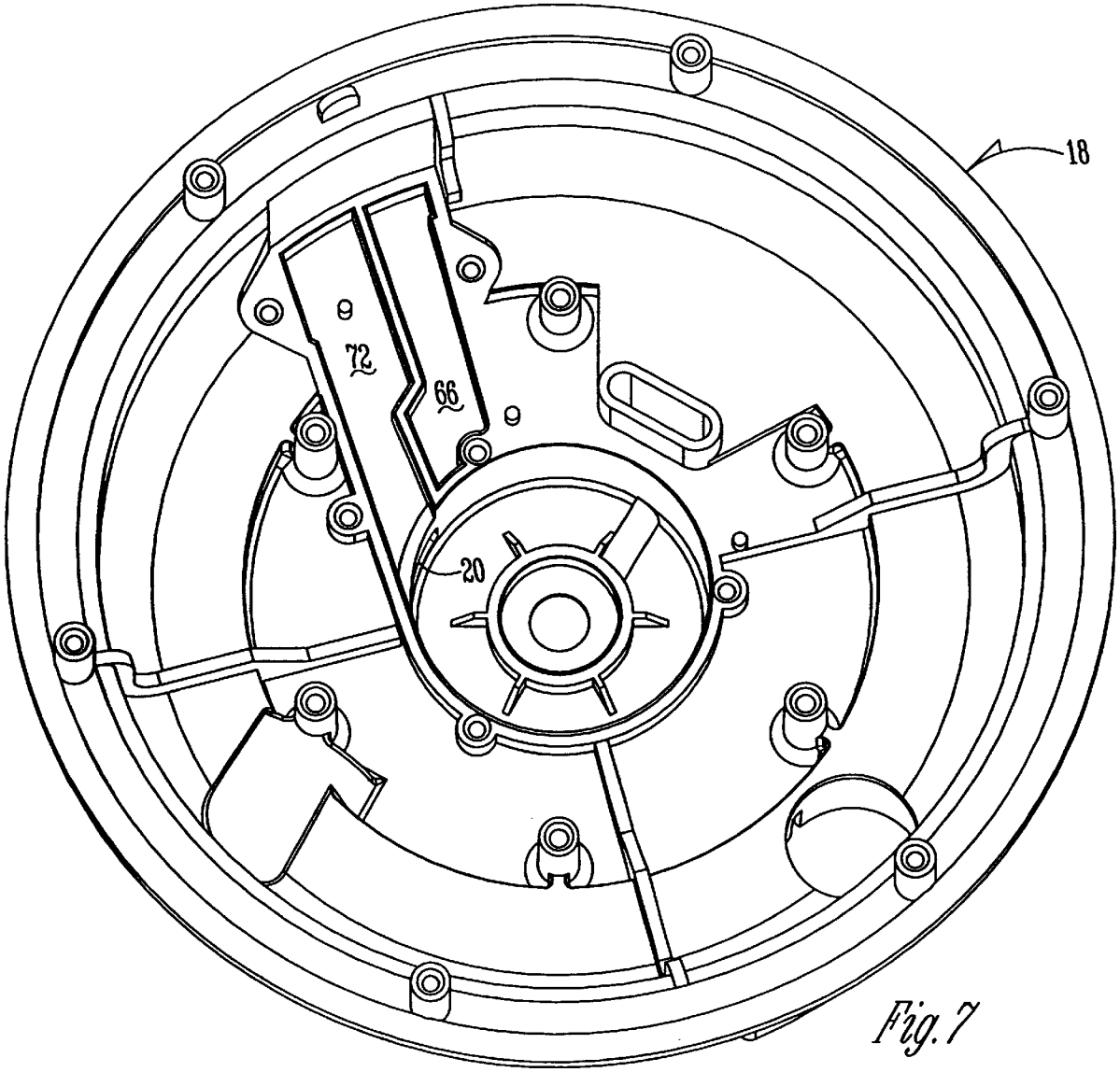
FIG. 7 is a perspective view of the pump housing with the drain cover removed.

FIG. 6 shows a detailed perspective view of the pump housing 18 and the drain cover 24. FIG. 7 shows the pump housing 18 with the drain cover 24 removed. For purposes of clarity, the other components, including the drain impeller 22, are not shown. As shown in FIG. 7, the drain outlet 20 is formed at the bottom of the pump housing 18. Also formed in the pump housing 18 are the first and second channels 66 and 72. When the drain cover 24 is placed over the pump housing 18 (FIG. 6) the channels 66 and 72 are enclosed. The first channel 66 extends from an opening 78 formed in the drain cover 24 to the port 80 which is in communication with the input channel 68 of the secondary filter assembly 48. In this way, as shown in FIG. 4, during the wash, rinse and drain modes of operation, wash water flows through the opening 64 of the suction plate 34, through the opening 78 of the drain cover 24, through the channel 66, and through the port 80 and into the secondary filter assembly 48.

The second channel 72 extends from the port 82 and along the bottom of the pump housing 18. In this way, as shown in FIG. 5, wash water can drain from the secondary filter assembly 48, through the port 82, through the second channel 72, and finally out through the drain outlet 20.

Also shown in FIG. 5 is a check valve 86 formed in the channel 72. Within the check valve 86 is a spherical plastic ball 88 which has a mating seat 90 formed slightly above the ball 88, as further shown in FIG. 5. When wash water flows in the direction shown in FIG. 5 during the draining process, the ball 88 is pushed to the position shown so that wash water along with filtered fine food and dirt particles will flow through the check valve 86 around the ball 88. If, at any time, pressure is applied to the ball 88 in a direction opposite to that shown in FIG. 5, the ball will engage the seat 90, blocking the flow of wash water from the channel 72 into the secondary filter assembly 48. During wash, the drain impeller 22 rotates backward causing a positive pressure which holds the ball 88 in the seat 90. In drain, with the drain impeller 22 rotating in its pumping direction, the pressure at the ball 88 from the drain or second channel 72 is essentially zero, allowing the ball 88 to drop from the seat 90. The check valve 86 prevents back flow from entering the secondary filter assembly 48 but also acts as a relief valve to help keep the filter screen 54 from being tightly packed with debris. As described above, the secondary filtering system takes its sampling from wash water already passed through the primary filter. The longer the sampling time for the secondary filter, the cleaner the wash water will become.

When heavy soil levels are encountered, the secondary filter assembly 48 takes such a heavy sampling of food soil in the first wash that the filter mesh 54 cannot be cleaned sufficiently by the wash arm 58 to prevent pressure build-up in the secondary filter assembly 48. With this build-up of pressure, the ball 88 of the check valve 86 will unseat and the food debris in the secondary filter assembly 48 is free to escape through the second channel 72. The pump then operates essentially as if there is no secondary filtering assembly 48.

Figure 8:
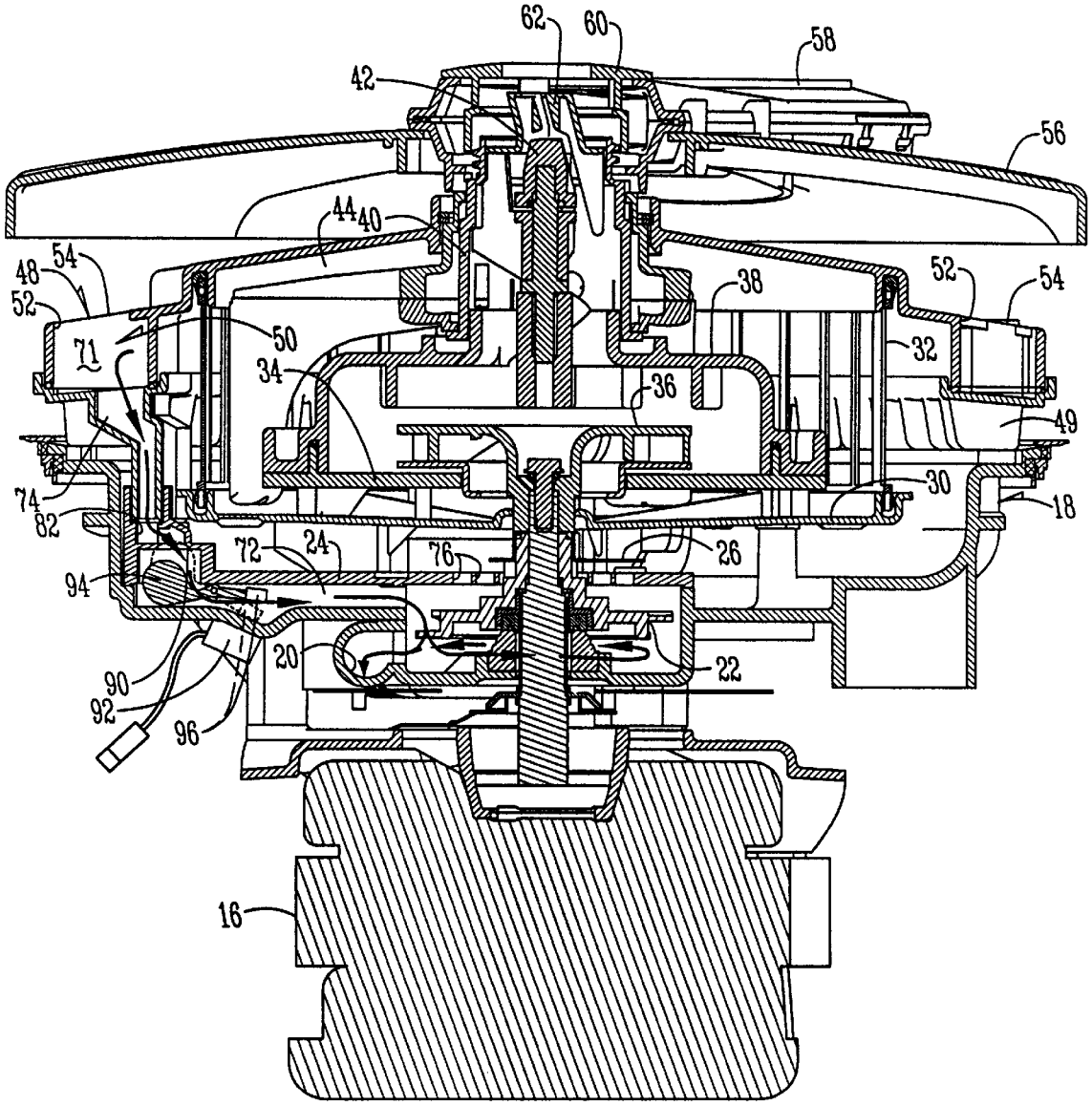
FIG. 8 is a sectional view of an alternate embodiment of the pump assembly shown in FIG. 5.
Figure 9:
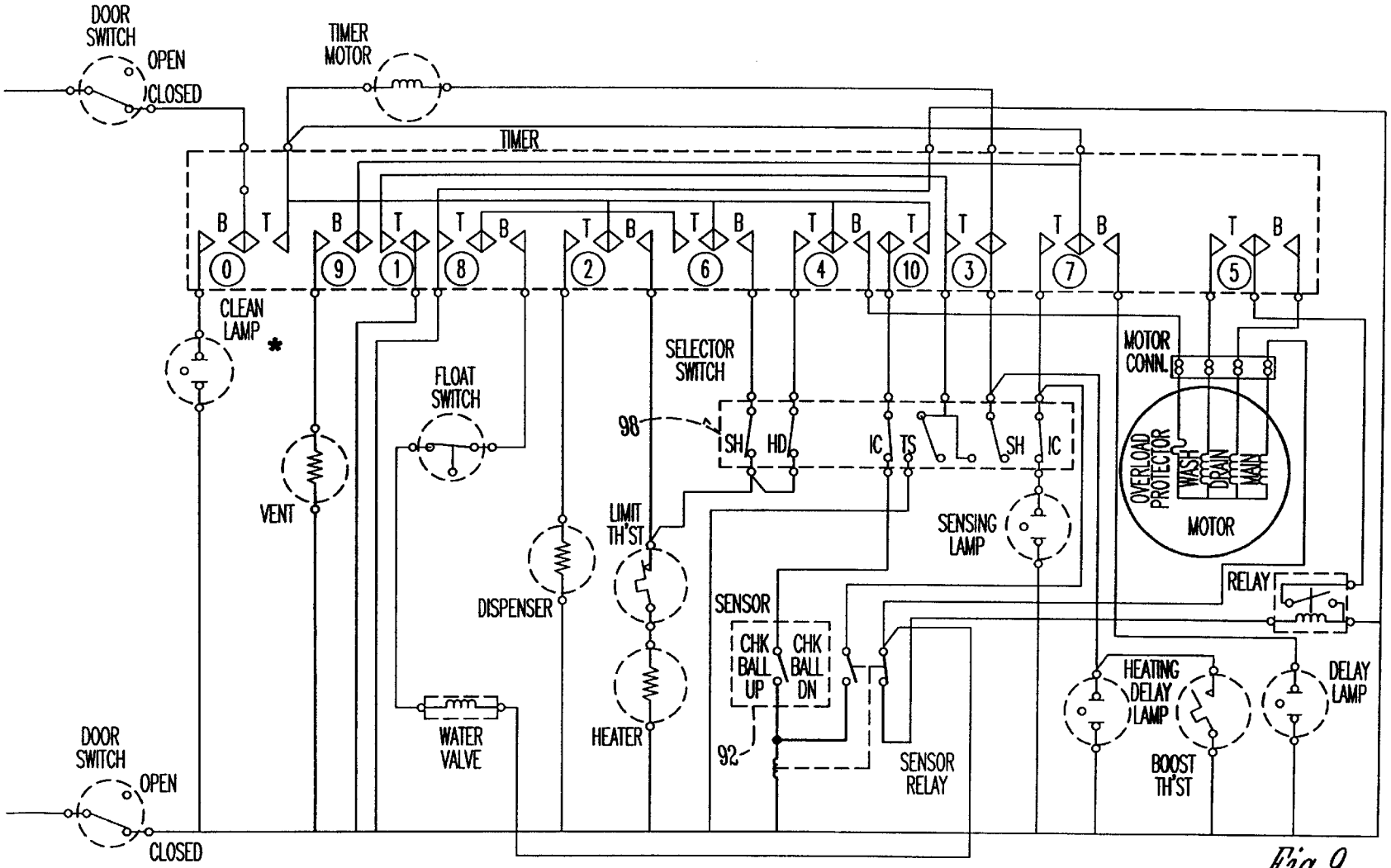
FIG. 9 is an electrical schematic diagram of a circuit utilizing the embodiment shown in FIG. 8.

FIGS. 8 and 9 illustrate an alternative check valve 86. FIG. 8 shows a sensor 92 (e.g., a reed switch, hall effect sensor, pressure sensor, etc.) that senses when the check ball 94 is unseated (therefore effectively sensing the amount of food soil in the secondary filter). If the check ball 94 becomes unseated, the dishwasher 10 is enabled to drain at the next opportunity (or immediately depending on the type of dishwasher control), and then refill with clean water. This flushes out the secondary filter assembly 48 and the check ball 94 will reset, so sample accumulation again initiates. If the check ball 94 is not unseated by pressure build-up in the secondary filter assembly 48, the dishwasher 10 would skip the next drain and fill, continuing instead to accumulate food soil in the secondary filter assembly 48. For pots and pans cycles, for example, the dishwasher 10 could potentially skip two drains and fills.

The sensor 92 could be very low cost and is workable with both timers and microprocessors. In the example shown in FIG. 8, the check ball 94 is comprised of a ball pivoted about a pivot point such that movement of the check ball 94 causes an arm 96 to move relative to the sensor 92.

FIG. 9 is an electrical schematic diagram illustrating how the sensor 92 and check valve 94 could be used with a dishwasher control. The sensor 92 is used as a switch connected to a selector switch 98, also shown in FIG. 1, which is used to select between operating modes such as sani heat (SH), heated dry (HD), intelliclean (IC), temperature sense (TS), and sani heat (SH). In this example, when the check ball 94 is seated (up), the circuit shown is open. When the check ball 94 is unseated (down), the circuit shown is closed.

Water and energy savings with this system could be substantial. Microprocessors offer even more potential for energy savings, as they could react immediately to the check ball 94 being unseated and refill the dishwasher with clean water to resume cleaning and collection in the secondary filter.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A water circulation system for a dishwasher having a washing compartment, a drain, a pump housing, a recirculation pump within the housing for recirculating wash water to the washing compartment to clean objects therein, the water circulation system comprising:

a primary filter for filtering objects from the wash water before it reaches the recirculating pump;

a secondary filter for filtering wash water that has been filtered by the primary filter;

a first passageway in communication with the pump housing for supplying wash water from the recirculation pump to a wash arm;

a second passageway in communication with the pump housing for supplying wash water from the recirculation pump to the secondary filter;

a chamber in communication with the second passageway for receiving wash water from the recirculation pump;

an aperture formed in the chamber between the interior of the chamber and the exterior of the chamber;

the secondary filter being disposed in the aperture for filtering wash water passing through the aperture;

a third passageway in communication with the chamber and with the drain for draining the wash water from the chamber;

any particles filtered by the second filter being washed away into the drain via the third passageway;

the recirculation pump supplying a flow of wash water through the second passageway for washing the particles from the chamber during the draining of wash water;

a check valve formed in the third passageway for preventing wash water from entering the chamber through the third passageway; and the pump housing including a seat in the third passageway and the check valve is held in a closed posture against the seat by positive pressure from the pump while supplying wash water to the washing compartment.

2. The system of claim 1 wherein the chamber is an annular chamber having top, bottom, and side walls.

3. The system of claim 2, wherein the aperture is formed in the top wall of the annular chamber.

4. The system of claim 1 wherein the filter medium is comprised of a mesh.

5. The system of claim 1, further comprising a sensor for sensing the position of the check valve.

6. A water circulation system for a dishwasher having a washing compartment, a drain, a pump housing, a pump within the housing for supplying wash water to the washing compartment to clean objects therein, the water circulation system comprising:

a primary filter for filtering objects from the wash water before it reaches the pump;

a secondary filter for filtering wash water that has been filtered by the primary filter;

a first passageway in communication with the pump housing for supplying wash water from the pump to a wash arm;

a second passageway in communication with the pump housing for supplying wash water from the pump to the secondary filter;

a chamber in communication with the second passageway for receiving wash water from the pump;

an aperture formed in the chamber between the interior of the chamber and the exterior of the chamber;

the secondary filter being disposed in the aperture for filtering wash water passing through the aperture;

a first wall formed in the chamber on a side opposite the side where the first passageway is formed; and a second wall coupled to and perpendicular to the first wall for causing the wash water entering the chamber to travel through the chamber.

7. The system of claim 6 further comprising a third partial wall perpendicular to the first wall for causing wash water entering the chamber to be deflected toward the bottom wall and then through the chamber toward the drain.

* * * * *